US007671878B2

(12) United States Patent
Yamada et al.

(10) Patent No.: US 7,671,878 B2
(45) Date of Patent: Mar. 2, 2010

(54) THERMAL PRINTER AND PAPER RECOGNITION METHOD

(75) Inventors: Satoshi Yamada, Mishima (JP); Sumio Baba, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 193 days.

(21) Appl. No.: 11/681,930

(22) Filed: Mar. 5, 2007

(65) Prior Publication Data

US 2007/0273744 A1 Nov. 29, 2007

(30) Foreign Application Priority Data

May 29, 2006 (JP) ..... 2006-148492
May 30, 2006 (JP) ..... 2006-150503
Jan. 11, 2007 (JP) ..... 2007-003500

(51) Int. Cl.
*B41J 2/32* (2006.01)

(52) U.S. Cl. ..... 347/171

(58) Field of Classification Search ..... 347/171–178, 347/212, 217, 218, 220–222; 400/120.02–120.04, 400/120.13, 120.16, 708
See application file for complete search history.

(56) References Cited

U.S. PATENT DOCUMENTS 6,118,469 A 9/2000 Hosomi
6,674,456 B2 1/2004 Miyazaki
6,759,366 B2 7/2004 Beckerdite et al.
6,784,906 B2 8/2004 Long et al.

FOREIGN PATENT DOCUMENTS

EP 1321296 6/2003
EP 1647411 4/2006
JP 58-008668 1/1983
JP 61-003765 1/1986
JP 01160656 6/1989
JP 03-051149 3/1991
JP 05069642 3/1993
JP 05-261978 10/1993
JP 06-024082 2/1994

(Continued)

OTHER PUBLICATIONS

Japanese Office Action dated Apr. 4, 2008 corresponding to U.S. Appl. No. 11/681,930, filed Mar. 5, 2007.

(Continued)

*Primary Examiner*—K. Feggins
(74) *Attorney, Agent, or Firm*—Turocy & Watson, LLP

(57) ABSTRACT

A thermal printer has a first thermal head, a second thermal head, and a feeding mechanism. The feeding mechanism feeds one of thermal papers which include a double-sided thermal paper having thermosensitive layers formed on both sides thereof and a single-sided thermal paper having a thermosensitive layer formed on one side thereof. The first thermal head is so provided as to be brought into contact with a first side of the thermal paper fed by the feeding mechanism. The second thermal head is so provided as to be brought into contact with a second side of the thermal paper fed by the feeding mechanism. The thermal printer determines whether a mark has been printed at least one of the first and second sides of the thermal paper and controls print operation based on a determination result.

12 Claims, 8 Drawing Sheets

FOREIGN PATENT DOCUMENTS

| | | |
|---|---|---|
| JP | 06-083241 | 3/1994 |
| JP | 09-233256 | 9/1997 |
| JP | 10-076713 | 3/1998 |
| JP | 11-286147 | 10/1999 |
| JP | 2000-094783 | 4/2000 |
| JP | 2000-315275 | 11/2000 |
| JP | 2001-199095 | 7/2001 |
| JP | 2003-039769 | 2/2003 |
| JP | 2004233705 | 8/2004 |

OTHER PUBLICATIONS

Japanese Office Action dated Jul. 3, 2008 corresponding to U.S. Appl. No. 11/681,930, filed Mar. 5, 2007.

European Search Report for European Application No. 0718850.4.

THERMAL PRINTER AND PAPER RECOGNITION METHOD

CROSS-REFERENCE TO RELATED APPLICATIONS

This application is based upon and claims the benefit of priority from prior Japanese Patent Applications No. 2006-148492, filed May 29, 2006; No. 2006-150503, filed May 30, 2006; and No. 2007-003500, filed Jan. 11, 2007, the entire contents of all of which are incorporated herein by reference.

BACKGROUND OF THE INVENTION

1. Field of the Invention

The present invention relates to a thermal printer capable of simultaneously printing an image on the obverse and reverse sides of a print medium.

2. Description of the Related Art

Jpn. Pat. Appln. Publication No. 11-2684167 discloses a thermal printer capable of simultaneously printing an image on the obverse and reverse sides of thermal paper. This printer has two platen rollers and two thermal heads.

This printer is capable of printing print data on both sides of thermal paper, thus making efficient use of the thermal paper.

In general, double-sided thermal paper is used for such a printer. Thermosensitive layers are respectively formed on both sides of the base paper. Further, single-sided thermal paper is known. In this case, a thermosensitive layer is formed only on one side of the base paper. If the single-sided thermal paper is used for the printer in place of the double-sided thermal paper and a thermal head on the side on which the surface has the thermosensitive layer is used to perform print operation, versatility can be enhanced.

BRIEF SUMMARY OF THE INVENTION

However, there is apparently little difference between the double-sided thermal paper and single-sided thermal paper. Therefore, there may occur a case where the single-sided thermal paper is loaded in a printer although double-sided printing is required, or where the double-sided thermal paper is loaded in a printer although single-sided printing is required.

A thermal printer according to the following embodiments has a feeding mechanism, a first thermal head, and a second thermal head. The feeding mechanism feeds one of thermal papers which include double-sided thermal paper having thermosensitive layers formed on both sides thereof and single-sided thermal paper having a thermosensitive layer formed on one side thereof. The first thermal head is so provided as to be brought into contact with a first side of the thermal paper fed by the feeding mechanism. The second thermal head is so provided as to be brought into contact with a second side of the thermal paper fed by the feeding mechanism. The thermal printer determines whether a mark has been printed on at least one of the first and second sides of the thermal paper and controls print operation based on a determination result.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and comprise a part of the specification, illustrate embodiments of the invention, and together with the general description given above and the detailed description of the embodiments given below, serve to explain the principles of the invention.

DETAILED DESCRIPTION OF THE INVENTION

First Embodiment

A thermal printer 10 according to a first embodiment of the present invention will be described below with reference to FIGS. 1 to 7.

Figure 1:
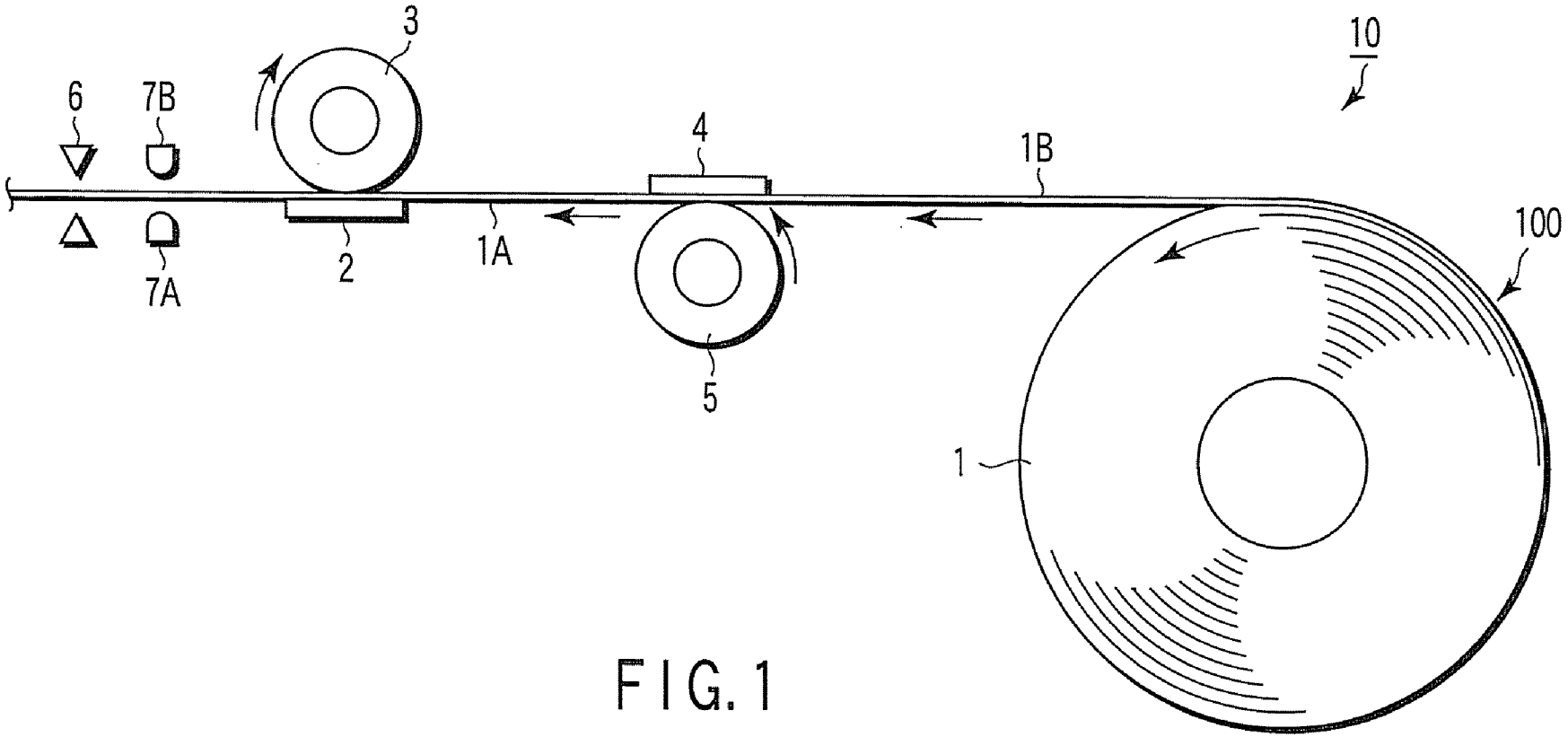
FIG. 1 is a view schematically showing a print mechanism section of a thermal printer according to a first embodiment.

FIG. 1 schematically shows a print mechanism section of the thermal printer 10. Thermal paper 1 wound in a roll is housed in a not shown paper housing section 100 of a printer main body. The leading end of the thermal paper 1 is drawn from the paper housing section 100 along a paper feeding path and discharged to the outside through a paper outlet.

First and second thermal heads 2 and 4 are provided along the paper feeding path. The second thermal head 4 is located on the paper housing section 100 side relative to the first thermal head 2.

The first thermal head 2 is so provided as to be brought into contact with one side (hereinafter, referred to as "obverse side 1A") of the thermal paper 1. A first platen roller 3 is so provided as to be opposed to the first thermal head 2 across the thermal paper 1.

The second thermal head 4 is so provided as to be brought into contact with the other side (hereinafter, referred to as "reverse side 1B") of the thermal paper 1. A second platen roller 5 is so provided as to be opposed to the second thermal head 4 across the thermal paper 1.

A cutter mechanism 6 for cutting off the thermal paper 1 is provided immediately on the upstream side of the paper outlet. First and second mark sensors 7A and 7B are so provided as to be opposed to each other across the thermal paper 1 between the cutter mechanism 6 and first thermal head 2. The first mark sensor 7A is a sensor for detecting a predetermined paper determination mark printed on the obverse side 1A of the thermal paper 1. The second mark sensor 7B is a sensor for detecting a predetermined paper determination mark printed on the reverse side 1B of the thermal paper 1. The details of the first and second mark sensor 7A and 7B will be described later.

The first and second thermal heads 2 and 4 each are a line thermal head in which a large number of heater elements are arranged in a line, and they are attached to the printer main body such that the arrangement direction of the heater elements crosses at right angles the feeding direction of the thermal paper 1.

The first and second platen rollers 3 and 5 are each formed in a cylindrical shape. When receiving a rotation of a paper feed motor 23 (to be described later) by a not shown power transfer mechanism, the first and second platen rollers 3 and 5 are rotated in the directions denoted by arrows of FIG. 1, respectively. The rotations of the platen rollers 3 and 5 feed the thermal paper 1 drawn from the paper housing section 100 in the direction of the arrow of FIG. 1 and discharged to outside through the paper outlet.

Figure 2:
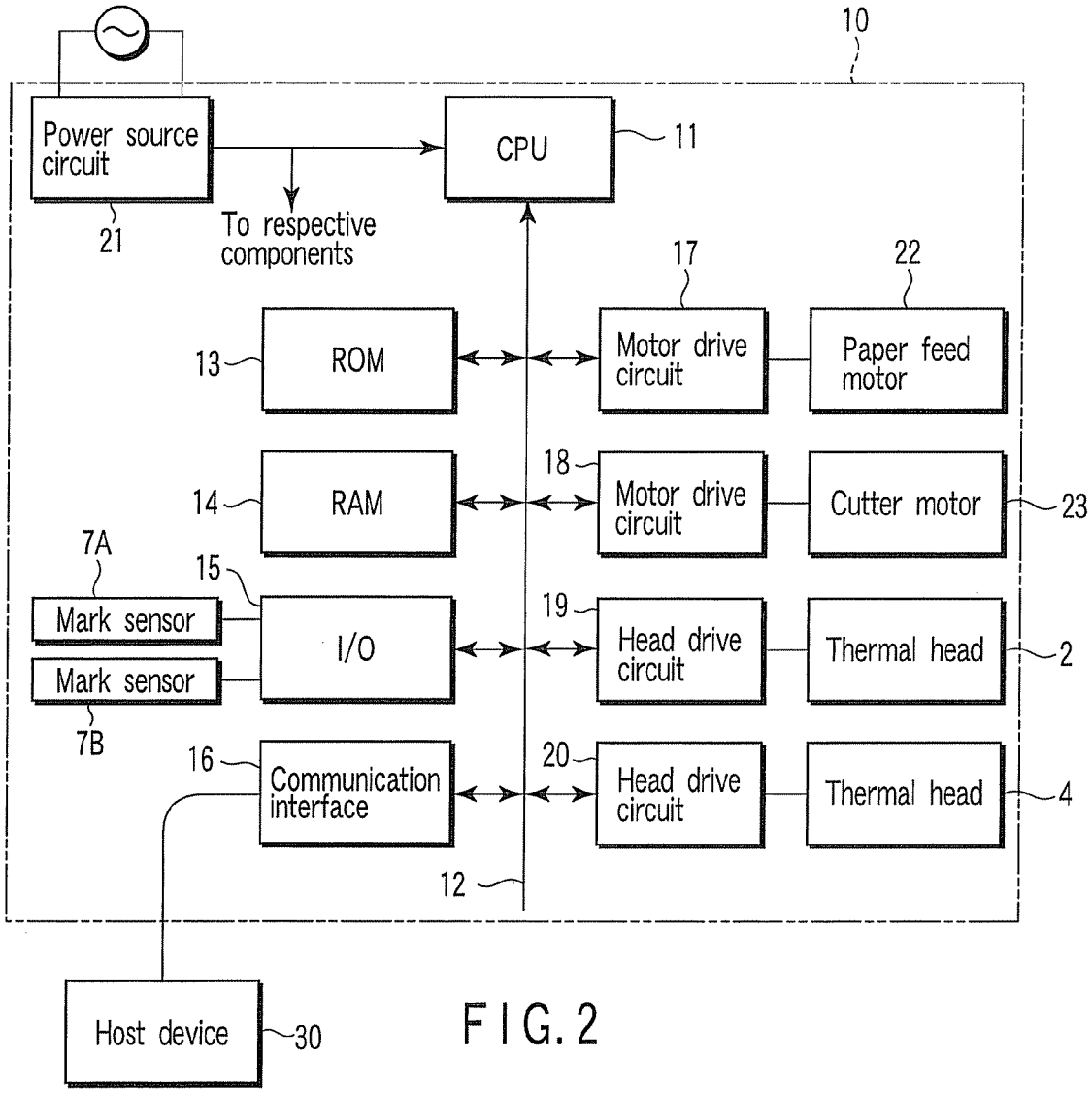
FIG. 2 is a block diagram showing a configuration of the main part of the thermal head provided in the thermal printer according to the first embodiment.

FIG. 2 is a block diagram showing a configuration of the main part of the thermal printer 10. The thermal printer 10 includes, as a controller main body, a central processing unit (CPU) 11. A read-only memory (ROM) 13, a random access memory (RAM) 14, an input/output (I/O) port 15, a communication interface 16, first and second motor drive circuits 17 and 18, and first and second head drive circuits 19 and 20 are connected to the CPU 11 through a bus line 12 such as an address bus, data bus, or the like. A drive current is supplied to the CPU 11 and the above components from a power source circuit 21.

A host device 30 for generating print data is connected to the communication interface 16. Signals from the first and second sensors 7A and 7B are input to the I/O port 15.

The first motor drive circuit 17 controls turning on and off of the paper feed motor 22 serving as a drive source of a paper feeding mechanism. The second motor drive circuit 18 controls on turning and off of a cutter motor 23 serving as a drive source of the cutter mechanism 6.

The first head drive circuit 19 drives the first thermal head 2. The second head drive circuit 20 drives the second thermal head 4.

Figure 3:
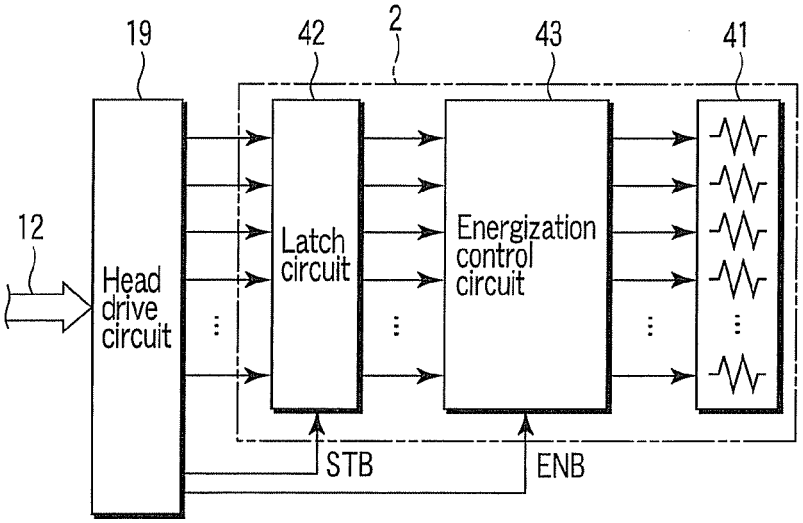
FIG. 3 is a block diagram showing a configuration of the main part of a thermal head provided in the thermal printer according to the first embodiment.

A correspondence between the first head drive circuit 19 and first thermal head 2 will be described using a block diagram of FIG. 3. Note that a correspondence between the second head drive circuit 20 and second thermal head 4 is the same, and description thereof will be omitted here.

The first thermal head 2 is constituted by a line thermal head main body 41 in which N heater elements are arranged in a line, a latch circuit 42 having a first-in-first-out function, and an energization control circuit 43. The head main body 41 is configured to print one-line data composed of N dots at a time. The latch circuit 42 latches the one-line data for each line. The energization control circuit 43 selectively energizes the heater elements of the head main body 41 in accordance with the one-line data latched by the latch circuit 42.

The first head drive circuit 19 outputs a serial data signal DATA and a latch signal LAT to the latch circuit 42 and outputs an enable signal ENB to the energization control circuit 43 every time it loads one-line data corresponding to N dots through the bus line 12.

The latch circuit 42 latches one-line data output from the head drive circuit 19 at the timing at which the latch signal LAT becomes active. The energization control circuit 43 energizes the heater elements corresponding to the print dots of the one-line data latched by the latch circuit 42 while the enable signal ENB is active.

Figure 4:
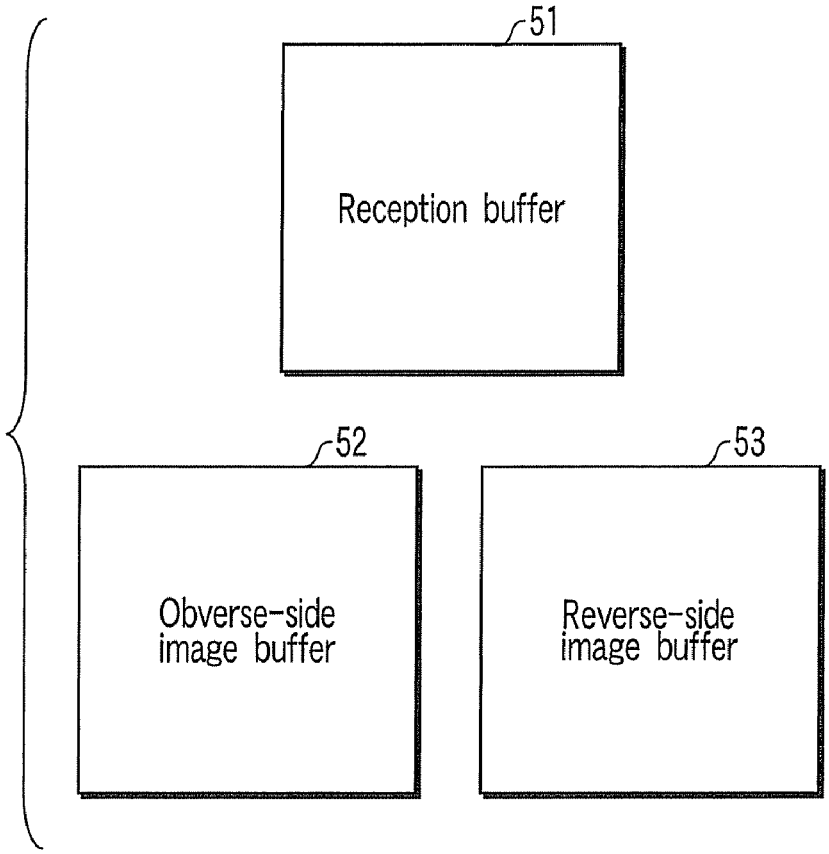
FIG. 4 is a view showing a main memory area allocated in a RAM provided in the thermal printer according to the first embodiment.

As shown in FIG. 4, the thermal printer 10 includes a reception buffer 51, a obverse-side image buffer 52, and a reverse-side image buffer 53. The reception buffer 51 receives print data from the host device 30 and temporarily stores the print data. In the obverse-side image buffer 52, dot image data of print data to be printed on the obverse side 1A of the thermal paper 1 is rendered as raster image data and stored. In the reverse-side image buffer 53, dot image data of print data to be printed on the reverse side 1B of the thermal paper 1 is rendered as raster image data and stored. The above buffers 51, 52, and 53 are allocated in the RAM 14.

Figure 5:
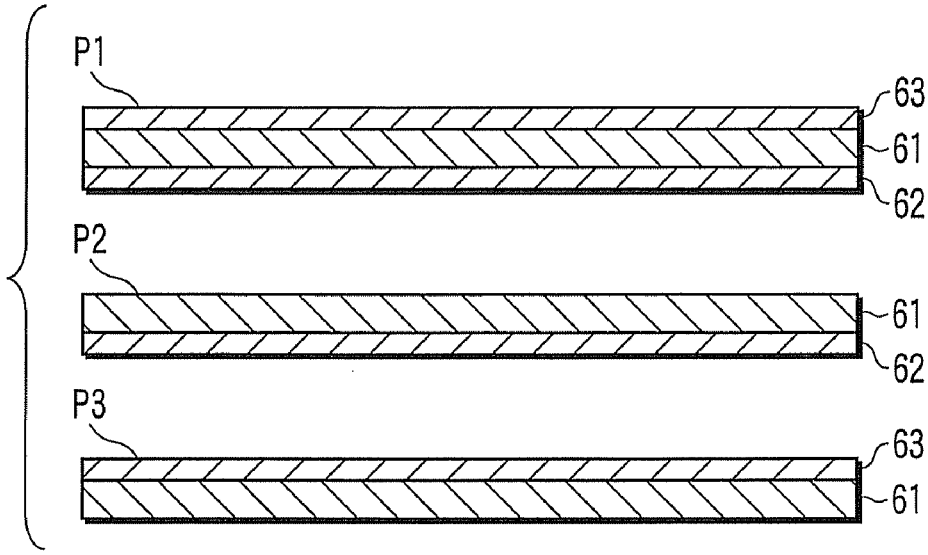
FIG. 5 is a cross-sectional view showing structures of thermal papers of each type used in the thermal printer according to the first embodiment.

FIG. 5 is a cross-sectional view of thermal papers P1 to P3 which can be used in the thermal printer 10. A thermal paper P1 is a double-sided thermal paper having print surfaces on both sides. The thermal paper P1 has thermosensitive layers 62 and 63 formed respectively on the obverse and reverse sides of a base paper 61. A thermal paper 2 is a obverse-sided thermal paper P2 having a print surface only on the obverse side. The thermal paper P2 has a thermosensitive layer 62 formed only on the obverse side of the base paper 61. A thermal paper 3 is a reverse-sided thermal paper P3 having a print surface only on the reverse side. The thermal paper P3 has a thermosensitive layer 63 formed only on the reverse side of the base paper 61. The obverse-sided thermal paper P2 and reverse-sided thermal paper P3 are collectively referred to as a single-sided thermal paper.

The thermosensitive layers 62 and 63 each are formed of a material developing a desired color such as black or red when it is heated to more than a predetermined temperature. The thermal papers P1 to P3 are each stored in the paper housing section 100 of the printer main body in a state where it is wound in a roll with the obverse side 1A facing inward as shown in FIG. 1.

Figure 7:
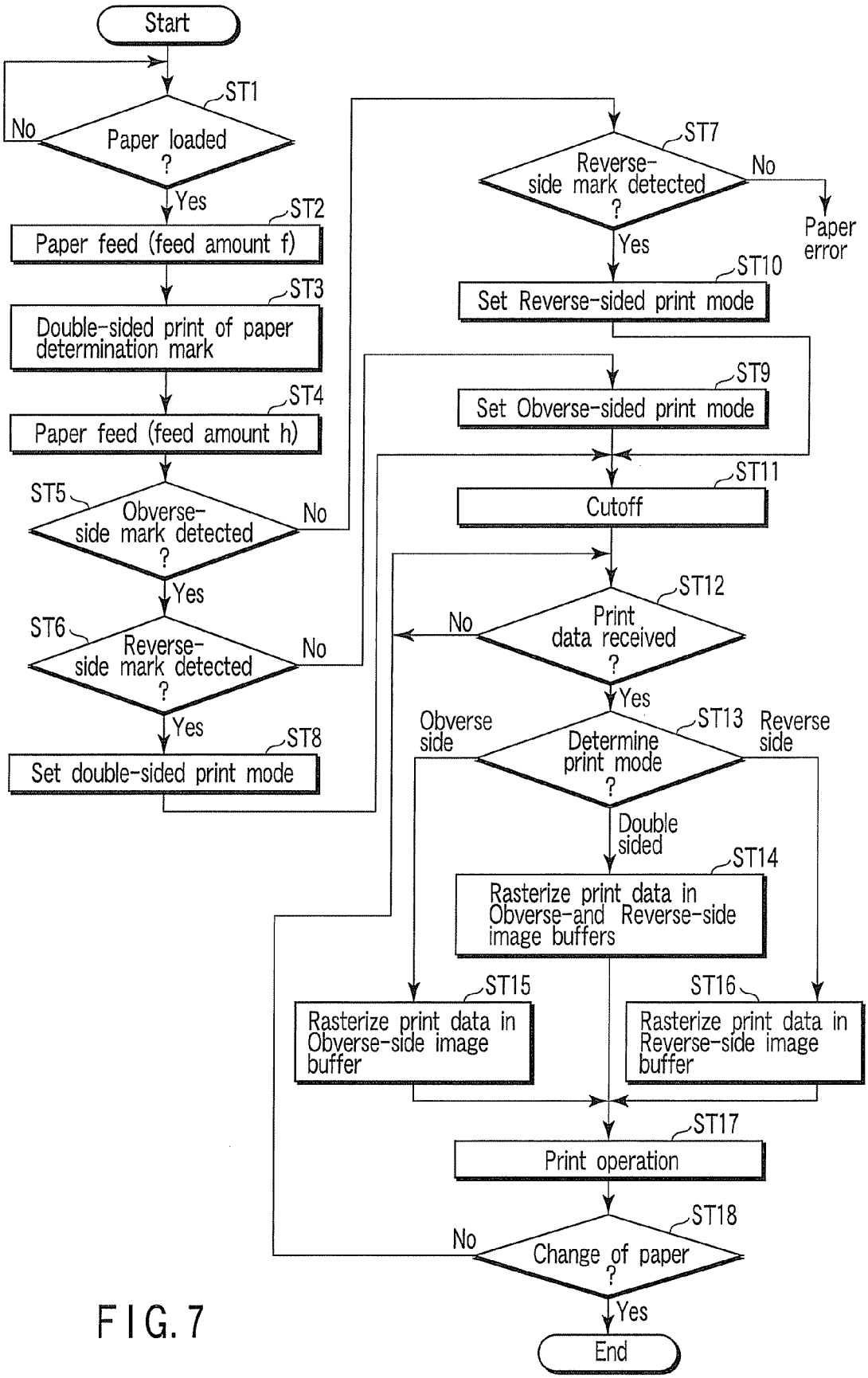
FIG. 7 is a flowchart showing the procedure of control operation performed by a CPU of the thermal printer according to the first embodiment.

The CPU 11 executes processing according to the procedure shown by a flowchart of FIG. 7 in response to power-on operation or reset operation after paper change operation.

The CPU 11 determines in step ST1 whether the thermal paper 1 has been loaded properly.

Procedure of changing the thermal paper 1 in the thermal printer 10 is as follows.

Firstly, a user opens the cover of the printer main body and loads new paper 1 in the paper housing section 100. Then, the user pulls out the leading end of the paper 1 to allow the leading end to pass between the second thermal head 4 and second platen roller 5. Further, the user allows the leading end of the paper 1 to pass between the first thermal head 2 and first platen roller 3 and closes the cover.

In the thermal printer 10, a paper sensor is disposed between the first and second thermal heads 2 and 4. In addition, a cover open/close sensor is disposed. When detecting open/close of the cover by the open/close sensor, the CPU 11 checks the paper sensor. When detecting the paper, the CPU 11 determines that the paper has been loaded properly. Such a paper sensor and open/close sensor are known techniques.

After determining that the paper 1 has been loaded properly, the CPU 11 controls the paper feed motor 22 to perform preliminary feeding of the paper 1 by a predetermined amount f (step ST2). The feed amount f substantially corresponds to the distance between the first thermal head 2 and cutter 6.

After performing the preliminary feeding of the paper 1 by a predetermined amount f, the CPU 11 prints a paper determination mark on both sides of the paper 1 (step ST3) by the procedure described below.

The CPU 11 first stores print data of the paper determination mark previously stored in the ROM 13 in the obverse-side image buffer 52 and reverse-side image buffer 53, respectively. Then, the CPU 11 sequentially outputs the print data stored in the obverse-side image buffer 52 to the first head drive circuit 19. Similarly, the CPU 11 sequentially outputs the print data stored in the reverse-side image buffer 53 to the second head drive circuit 20.

Thus, in the case where the thermosensitive layer 62 is formed on the obverse side 1A of the paper 1, the paper determination mark is printed on the obverse side 1A by the first thermal head 2. In the case where the thermosensitive layer 63 is formed on the reverse side 1B of the paper 1, the paper determination mark is printed on the reverse side 1B by the second thermal head 4.

After completion of the paper determination mark print operation, the CPU 11 controls the paper feed motor 22 to perform preliminary feeding of the paper 1 once again by a predetermined amount h (step ST4). The feed amount h is slightly larger than the distance between the second thermal head 4 and cutter 6.

Figure 6:
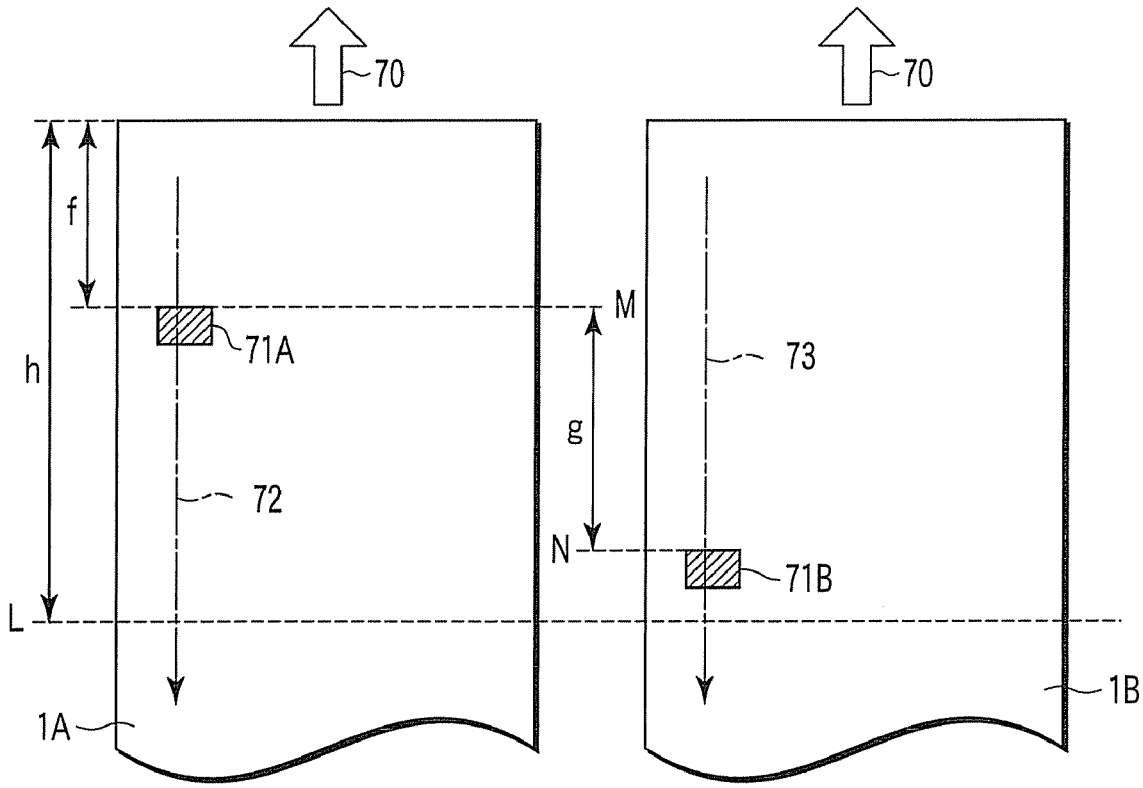
FIG. 6 is a view showing a state where a paper determination mark has been printed on the thermal paper by the thermal printer according to the first embodiment.

An example of a state of the obverse and reverse sides 1A and 1B of the paper 1 at this time is shown in FIG. 6. In FIG. 6, an arrow 70 denotes the feeding direction of the paper 1. A gap g denotes the distance between the first and second thermal heads 2 and 4. After the paper 1 has been fed by a predetermined amount f in step ST2, the first thermal head 2 is located at the position denoted by a broken line M on the obverse side 1A while the second thermal head 4 is located at the position denoted by a broken line N on the reverse side 1B.

When the paper determination mark print operation is performed in step ST3, if the thermosensitive layer 62 is formed on the obverse side 1A of the paper 1, a paper determination mark 71A is printed on the obverse side 1A at the position shown in FIG. 6. Similarly, if the thermosensitive layer 63 is formed on the reverse side 1B, a paper determination mark 71B having the same pattern as the paper determination mark 71A is printed on the reverse side 1B at the position shown in FIG. 6.

After the paper 1 has been fed by a predetermined amount h in step ST4, the cutter mechanism 6 is located at the position denoted by a broken line L. The scanning trace of the first mark sensor 7A while the paper 1 is being fed by a predetermined amount h is denoted by an arrow 72 of FIG. 6, and the scanning trace of the second marl sensor 7B is denoted by an arrow 73.

Each of the mark sensors 7A and 7B is a reflection type optical sensor in which light-emitting elements and light-receiving elements are arranged side by side. The mark sensors 7A and 7B measure a light reflection amount along their scanning traces 72 and 73 and, when detecting the color of the paper determination marks 71A and 71B, output signals indicating the presence of the mark. Although each of the paper determination marks 71A and 71B is formed into a rectangular shape in FIG. 6, the shape or color of the mark is not especially limited as long as the mark can be detected by the mark sensors 7A and 7B.

After completion of the preliminary feeding of the paper 1 by a predetermined amount h, the CPU 11 checks detection signals obtained by the mark sensors 7A and 7B (steps S5 to S7). Based on the detection results, the CPU 11 recognizes the type of the paper 1 and sets a print mode corresponding to the paper type.

In the case where the first mark sensor 7A has detected the paper determination mark 71A and second mark sensor 7B has detected the paper determination mark 71B, the CPU 11 recognizes that the loaded paper 1 is the double-sided thermal paper P1 having print surfaces on both sides thereof. Then, the CPU 11 sets a double-sided print mode (step ST8).

In the case where the first mark sensor 7A has detected the paper determination mark 71A while the second mark sensor 7B has not detected the paper determination mark 71B, the CPU 11 recognizes that the loaded paper 1 is the obverse-sided thermal paper P2 having a print surface only on the obverse side 1A thereof. Then, the CPU 11 sets a obverse-sided print mode (step ST9).

In the case where the first mark sensor 7A has not detected the paper determination mark 71A while the second mark sensor 7B has detected the paper determination mark 71B, the CPU 11 recognizes that the loaded paper 1 is the reverse-sided thermal paper P3 having a print surface only on the reverse side 1B thereof. Then, the CPU 11 sets a reverse-sided print mode (step ST10).

In the case where both the mark sensors 7A and 7B have not detected the paper determination marks 71A and 71B, the CPU 11 recognizes that the paper 1 not the thermal paper. In this case, the CPU 11 issues error notification about the paper.

For example, the CPU 11 outputs a paper error signal to the host device 30. Upon receiving the error signal, the host device 30 displays a message notifying a user that paper which cannot be used in the printer has been loaded. In the case where an operation panel is provided on the printer main body, the CPU 11 may display the paper error message on a display section of the panel to notify the user of the error.

After any one of the print modes has been set, the CPU 11 activates the cutter motor 23 to cut off the paper 1 (step ST11). The paper 1 is cut off along a cutoff line L to thereby separate the paper leading end portion on which at least one of the paper determination marks 71A and 71B has been printed.

Thereafter, the CPU 11 waits for receiving print data to be transmitted from the host device (step ST12). Upon receiving the print data and storing it in the reception buffer 51, the CPU 11 determines a print mode (step ST13).

In the case where the double-sided print mode has been set, the CPU 11 sequentially renders print data as raster image data starting from the beginning of the data and stores the raster image data separately in the obverse-side image buffer 52 and reverse-side image buffer 53 (step ST14). The CPU 11 then outputs the raster image data stored in the obverse-side image buffer 52 to the first head drive circuit 19 one line by one line and, at the same time, outputs the raster image data stored in the reverse-side image buffer 53 to the second head drive circuit 20 one line by one line (step ST17). As a result, the first and second thermal heads 2 and 4 start print operation.

In this case, the paper 1 is the double-sided thermal paper P1 having print surfaces on both the obverse and reverse sides 1A and 1B thereof. Accordingly, data is printed on both the obverse and reverse sides 1A and 1B of the double-sided thermal paper P1 by the first and second thermal heads 2 and 4.

In the case where the obverse-sided print mode has been set, the CPU 11 sequentially renders print data as raster image data starting from the beginning of the data and stores the raster image data only in the obverse-side image buffer 52 (step ST15). The CPU 11 then outputs the raster image data stored in the obverse-side image buffer 52 to the first head drive circuit 19 one line by one line (step ST17). As a result, the first thermal head 2 starts print operation.

In this case, the paper 1 is the obverse-sided thermal paper P2 having a print surface on the obverse side 1A. Accordingly, data is printed on the obverse side 1A of the obverse-sided thermal paper P2 by the first thermal head 2.

In the case where the reverse-sided print mode has been set, the CPU 11 sequentially renders print data as raster image data starting from the beginning of the data and stores the raster image data only in the reverse-side image buffer 53 (step ST16). The CPU 11 then outputs the raster image data stored in the reverse-side image buffer 53 to the second head drive circuit 20 one line by one line (step ST17). As a result, the second thermal head 4 starts print operation.

In this case, the paper 1 is the reverse-sided thermal paper P3 having a print surface on the reverse side 1B. Accordingly, data is printed on the reverse side 1B of the reverse-sided thermal paper P3 by the second thermal head 4.

The CPU 11 executes the above processing from steps ST13 to ST17 every time the CPU 11 receives print data from the host device 30.

If a reset is done for change of the paper (step ST18), the CPU 11 cancels the current print mode to end this flow. The print mode is canceled also when a power of the printer main body is turned off.

In the thermal printer 10 according to the first embodiment, at the time point when the paper 1 has been loaded or at the start time of the printer, print operation of the paper determination marks 71A and 71B on the obverse and reverse sides 1A and 1B of the paper 1 is started. Then, the presence/absence of the paper determination marks 71A and 71B is checked by a pair of mark sensors 7A and 7B.

In the case where both the paper determination marks 71A and 71B have been printed, the paper 1 can be recognized as the double-sided thermal paper P1. In this case, the double-sided print mode is set. Then, print operation of the thermal printer 10 is controlled such that print data is printed on both sides of the paper.

In the case where only the paper determination mark 71A has been detected, the paper 1 can be recognized as the obverse-sided thermal paper P2. In this case, the obverse-sided print mode is set. Then, print operation of the thermal printer 10 is controlled such that print data is printed on the obverse side 1A of the paper.

In the case where only the paper determination mark 71B has been detected, the paper 1 can be recognized as the reverse-sided thermal paper P3. In this case, the reverse-sided print mode is set. Then, print operation of the thermal printer 10 is controlled such that print data is printed on the reverse side 1B of the paper.

Therefore, the double-sided print operation is performed only when the double-sided thermal paper P1 is used. When the obverse-sided thermal paper P2 is used, only the obverse-sided print operation by the first thermal head 2 is performed. When the reverse-sided thermal paper P3 is used, only the reverse-sided print operation by the second thermal head 4 is performed. As a result, it is possible to avoid a case where data is not printed due to use of a paper other than the double-sided thermal paper P1 when the double-sided print is performed.

Further, in the case where the single-sided thermal paper P2 or P3 is used, print data is printed on one print surface on which the thermosensitive layer has been formed. Therefore, a print job can be completed without fail when not only the double-sided thermal paper P1 but also the single-sided thermal paper P2 or P3 is used, thus enhancing versatility.

Second Embodiment

A configuration of a thermal printer 80 according to a second embodiment will be described below with reference to FIGS. 8 to 9.

Figure 8:
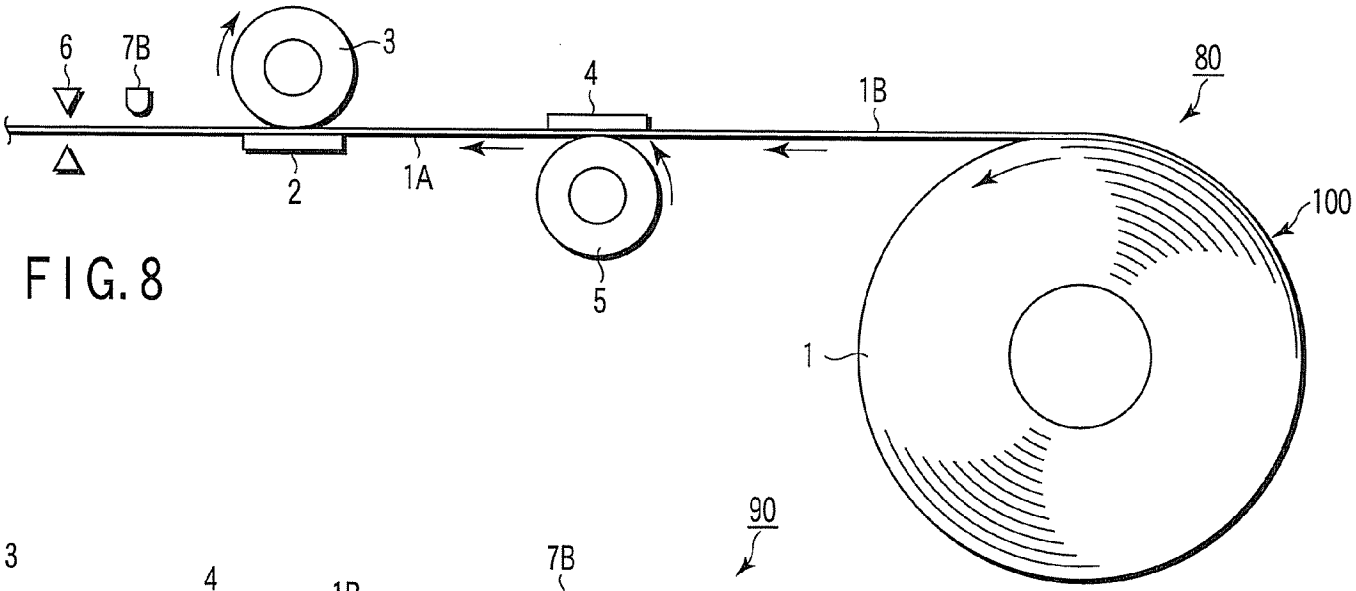
FIG. 8 is a view schematically showing a print mechanism section of a thermal printer according to a second embodiment.

FIG. 8 schematically shows a print mechanism section of the thermal printer 80. A difference point between the thermal printer 80 and thermal printer 10 is the number of mark sensors. More specifically, the thermal printer 80 only has the second mark sensor 7B while the first mark sensor 7A is omitted. Since the configurations of the other hardware components in the thermal printer 80 which are shown in FIGS. 1 to 4 are the same as those in the thermal printer 10, the same parts are indicated by the same reference numerals and detailed descriptions thereof will be omitted.

Two types of the thermal papers 1 can be used in the thermal printer 80, that is, the double-sided thermal paper P1 having print surfaces on both sides thereof and obverse-sided thermal paper (single-sided thermal paper) P2 having a print surface only on the obverse side.

Figure 9:
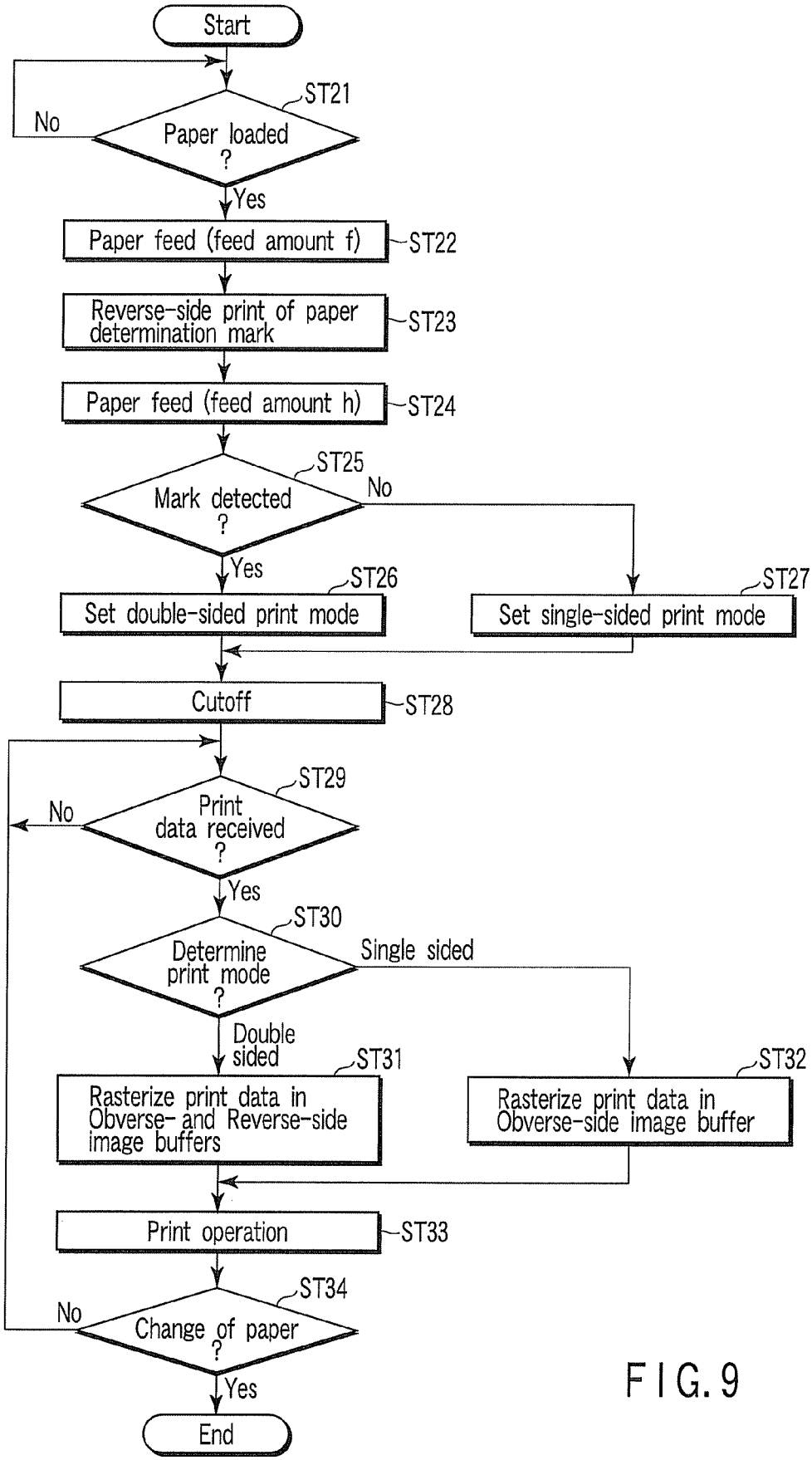
FIG. 9 is a flowchart showing the procedure of control operation performed by a CPU of the thermal printer according to the second embodiment.

The CPU 11 of the thermal printer 80 executes processing according to the procedure shown by a flowchart of FIG. 9 in response to power-on operation or reset operation after paper change operation.

The CPU 11 determines whether the thermal paper 1 has been loaded properly (step ST21). When determining that the paper 1 has been loaded properly, the CPU 11 controls the paper feed motor 22 to perform preliminary feeding of the paper 1 by a predetermined amount f (step ST22). As in the case of the first embodiment, the feeding amount f substantially corresponds to the distance between the first thermal head 2 and cutter 6.

After performing the preliminary feeding of the paper 1 by a predetermined amount f, the CPU 11 prints a paper determination mark on the reverse side of the paper 1 (step ST23). More specifically, the CPU 11 stores print data of the paper determination mark previously stored in the ROM 13 in the reverse-side image buffer 53. Then, the CPU 11 sequentially outputs the print data to the second head drive circuit 20.

Then, the CPU 11 controls the paper feed motor 22 to perform preliminary feeding of the paper 1 once again by a predetermined amount h (step ST24). As in the case of the first embodiment, the feed amount h is slightly larger than the distance between the second thermal head 4 and cutter 6.

The CPU 11 then determines whether the second mark sensor 7B has detected the paper determination mark 71B (step ST25). In the case where the paper determination mark 71B has been detected, the CPU 11 recognizes that the paper 1 is the double-sided thermal paper P1. Then, the CPU 11 sets the double-sided print mode (step ST26).

In the case where the paper determination mark 71B has not been detected, the CPU 11 recognizes that the paper 1 is the obverse-sided thermal paper P2. Then, the CPU 11 sets the single-sided print mode (step ST27).

After either of the print modes has been set, the CPU 11 activates the cutter motor 23 to cut off the paper 1 (step ST28) along a cutoff line L.

Thereafter, the CPU 11 waits for receiving print data to be transmitted from the host device (step ST29). Upon receiving the print data and storing it in the reception buffer 51, the CPU 11 determines a print mode (step ST30).

In the case where the double-sided print mode has been set, the CPU 11 sequentially renders print data as raster image data starting from the beginning of the data and stores the raster image data separately in the obverse-side image buffer 52 and reverse-side image buffer 53 (step ST31). The CPU 11 then outputs the raster image data stored in the obverse-side image buffer 52 to the first head drive circuit 19 one line by one line and, at the same time, outputs the raster image data stored in the reverse-side image buffer 53 to the second head drive circuit 20 one line by one line (step ST33). As a result, the first and second thermal heads 2 and 4 start print operation.

In this case, the paper 1 is the double-sided thermal paper P1 having print surfaces on both the obverse and reverse sides 1A and 1B thereof. Accordingly, data is printed on both the obverse and reverse sides 1A and 1B of the double-sided thermal paper P1 by the first and second thermal heads 2 and 4.

In the case where the single-sided print mode has been set, the CPU 11 sequentially renders print data as raster image data starting from the beginning of the data and stores the raster image data only in the obverse-side image buffer 52 (step ST32). The CPU 11 then outputs the raster image data stored in the obverse-side image buffer 52 to the first thermal head 2 one line by one line (step ST33). As a result, the first thermal head 2 starts print operation.

In this case, the paper 1 is the obverse-sided thermal paper P2 having a print surface on the obverse side 1A. Accordingly, data is printed on the obverse side 1A of the obverse-sided thermal paper P2 by the first thermal head 2.

The CPU 11 executes the above processing from steps ST29 to ST33 every time the CPU 11 receives print data from the host device 30.

If a reset is done for change of the paper (step ST34), the CPU 11 cancels the current print mode to end this flow. The print mode is canceled also when a power of the printer main body is turned off.

Also in the thermal printer 80 according to the second embodiment, the double-sided print operation is performed when the double-sided thermal paper P1 is used, and single-sided print operation is performed when the obverse-sided thermal paper P2 is used. Therefore, it is possible to obtain the same effect as the first embodiment.

In the above-mentioned embodiments, the feed amount f is set to a value substantially equal to the distance between the first thermal head 2 and cutter mechanism 6 in the processing of steps ST2 and ST22. However, the feed amount is not especially limited as long as the paper determination marks 71A and 71B can be printed on both sides of the paper 1 by the first and second thermal heads 2 and 4.

Further, the feed amount h is set to a value slightly larger than the distance between the second thermal head 4 and cutter mechanism 6 in the processing of steps ST4 and ST24. However, in the case where the paper on which the paper determination mark 71A and 71B have been printed is used without being cut off, the feed amount f is not especially limited.

For example, this kind of the thermal printer is used as a receipt printer of Point Of Sales (POS) terminal. On a receipt printed by the receipt printer, a logo mark such as a shop name is generally printed at the upper portion thereof. Thus, this logo mark is used as the paper determination mark. This eliminates the need to cut off the paper on which the paper determination mark has been printed after determination of the paper type.

The single-sided thermal paper used in the second embodiment may be the reverse-sided thermal paper P3. In this case, the thermal printer 80 only has the first mark sensor 7A. When the single-sided print mode has been set, the CPU 11 stores raster image data of print data in the reverse-side image buffer 53 in step S32. In step S33, the CPU 11 outputs the raster image data stored in the reverse-side image buffer 53 to the second head drive circuit 20 one line by one line. Also in this case, it is possible to obtain the same effect as the first embodiment.

Third Embodiment

A configuration of a thermal printer 90 according to the third embodiment will be described with reference to FIGS. 10 to 12.

Figure 10:
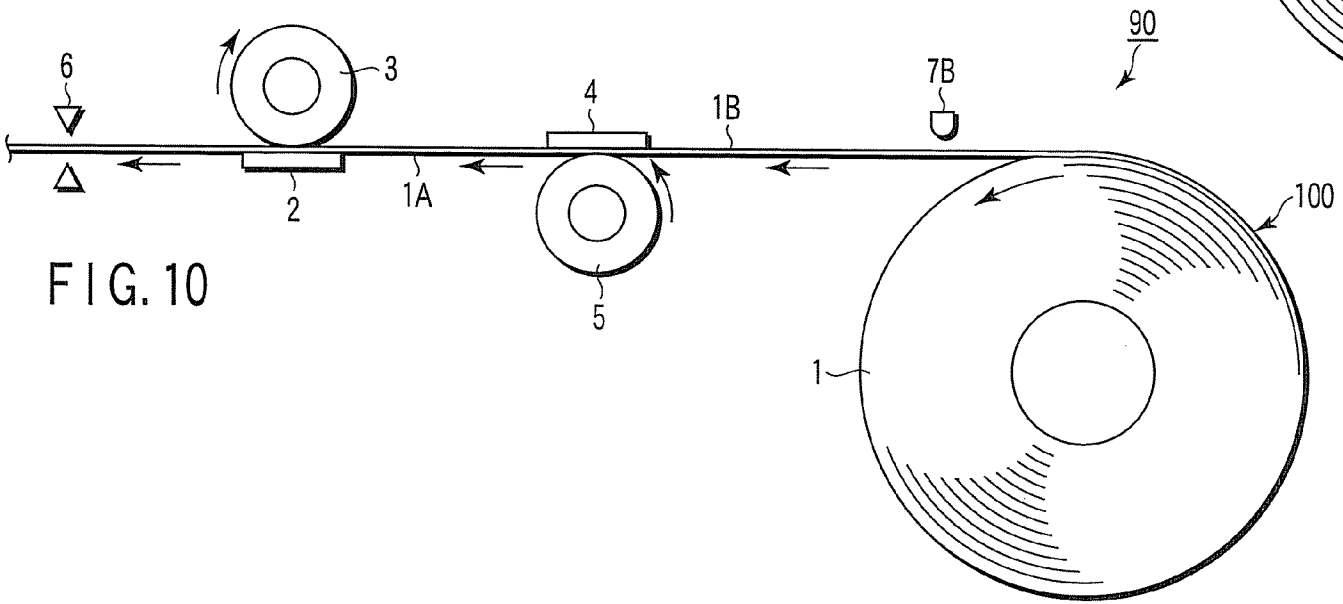
FIG. 10 is a view schematically showing a print mechanism section of a thermal printer according to a third embodiment.

FIG. 10 schematically shows a print mechanism section in the thermal printer 90. A difference point between the thermal printer 90 and thermal printers 10 and 80 is the number and position of mark sensors. More specifically, in the thermal printer 90, the second mark sensor 7B is provided at the position on the reverse side 1B side of the paper feeding path and between the point at which the paper 1 is drawn from the paper housing section 100 and second thermal head 4. The first mark sensor 7A is omitted. Since the configurations of the other hardware components in the thermal printer 90 are the same as those in the thermal printers 10 and 80, the same parts are indicated by the same reference numerals and detailed descriptions thereof will be omitted.

Two types of the thermal papers 1 can be used in the thermal printer 90, as in the case of the second embodiment, that is, the double-sided thermal paper P1 and obverse-sided thermal paper P2.

Figure 11:
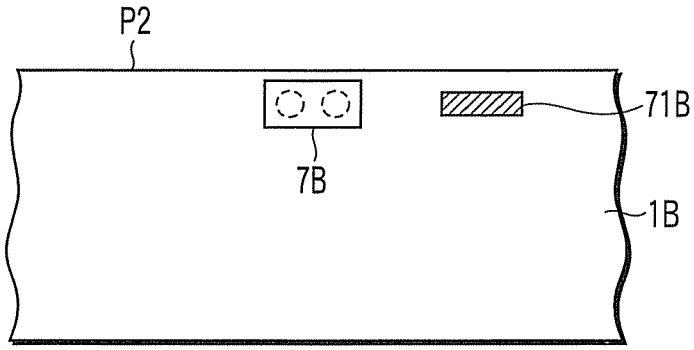
FIG. 11 is a view showing a relationship between the paper determination mark on the thermal paper and sensor used in the thermal printer according to the third embodiment.

As shown in FIG. 11, the paper determination mark 71B are previously printed at predetermined intervals at one end side in the width direction on the reverse side 1B on which thermosensitive print operation cannot be applied. This paper determination mark 71B is detected by the second mark sensor 7B.

The print mode of the thermal printer 90 includes the double-sided print mode and single-sided print mode, as in the case of the thermal printer 80. In the double-side mode, the first thermal head 2 and second thermal head 4 are used to print an image on both the obverse and reverse sides of the thermal paper 1. In the single-sided print mode, only the first thermal head 2 is used to print an image only on the obverse side of the thermal paper 1.

The thermal printers 10 and 80 are configured to automatically decide the print mode based on the presence/absence of the paper determination mark, while the thermal printer 90 is configured to allow a user to previously set a desired print mode.

Figure 12:
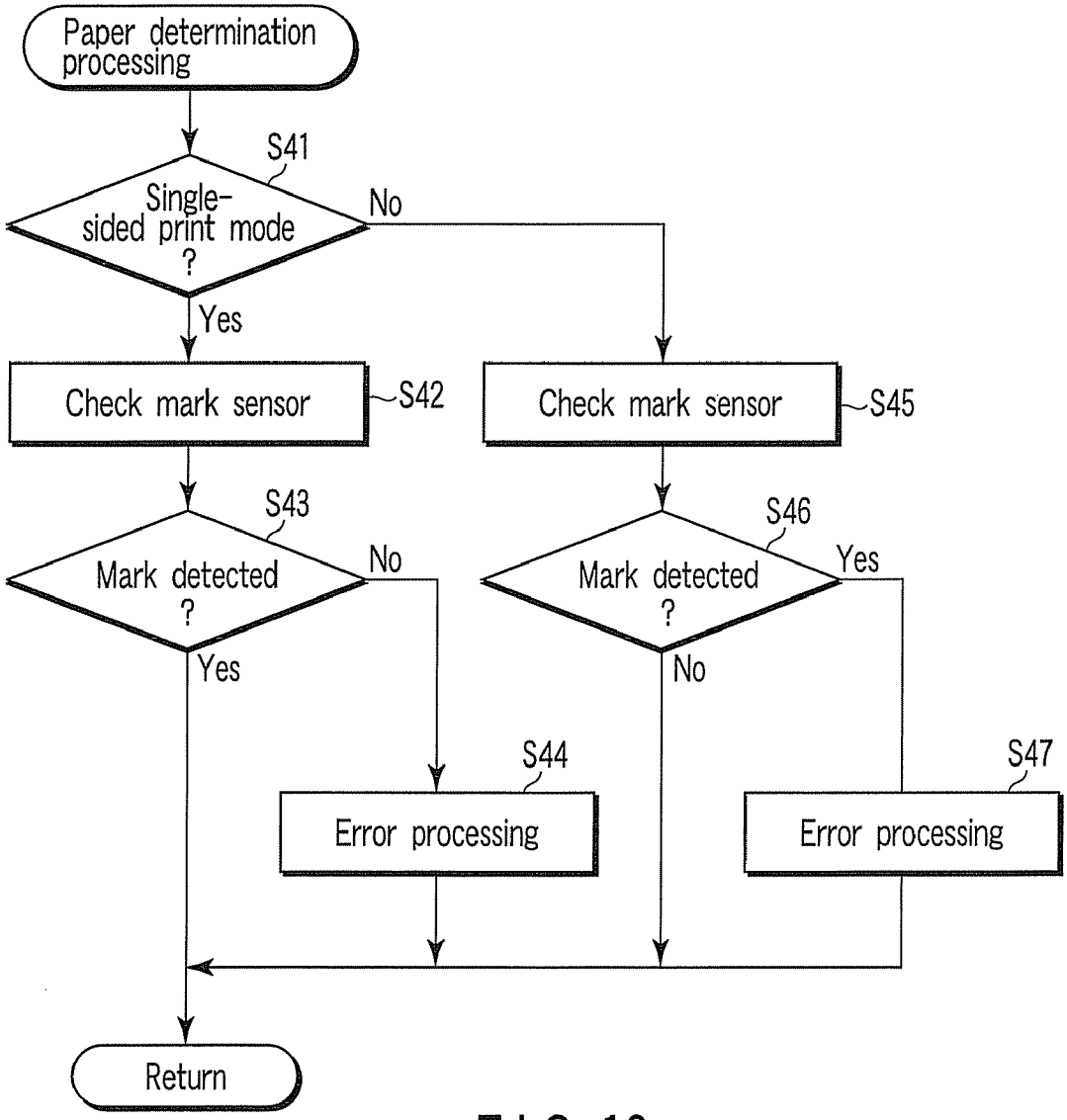
FIG. 12 is a flowchart showing paper determination processing performed by a CPU of the thermal printer according to the third embodiment.

Before starting print operation, the CPU 11 of the thermal printer 90 performs paper determination processing as shown in FIG. 12.

The CPU 11 determines whether the print mode is the single-sided print mode (step ST41). In the case where the print mode is the single-sided print mode, the CPU 11 checks a detection signal of the mark sensor 7B (step ST42). Then, the CPU 11 determines whether the mark sensor 7B has detected the paper determination mark 71B (step ST 43).

In the case where the paper determination mark 71B has been detected, the CPU 11 determines that the thermal paper 1 is normal. That is, the CPU 11 determines a normal state in which a roll paper of the obverse-sided thermal paper P2 is housed in the paper housing section 100 such that the obverse side to be printed faces the thermal head 2.

In the case where the paper determination mark 71B has not been detected, the CPU 11 determines an error has occurred. That is, the CPU 11 determines that a roll paper housed in the paper housing section 100 is not the obverse-sided thermal paper P2 that meets the obverse-sided print mode. In this case, the CPU 11 notifies a user of the error using an alarm sound, a light, or other means (step ST44).

Also in the case where the print mode is not the single print mode, that is, in the case where the double-sided print mode has been set, the CPU 11 checks a detection signal of the mark sensor 7B (step ST45). Then, the CPU 11 determines whether the mark sensor 7B has detected the paper determination mark 71B (step ST46).

In the case where the paper determination mark 71B has been detected, the CPU 11 determines that the thermal paper 1 is inadequate one. That is, the CPU 11 determines that a roll paper housed in the paper housing section 100 is the obverse-sided thermal paper P2 that does not meet the double-sided print mode. In this case, the CPU 11 notifies a user of the error using an alarm sound, a light, or other means (step ST47).

In the case where the paper determination mark 71B has not been detected, the CPU 11 determines the loaded paper is a proper one. That is, the CPU 11 determines that a roll paper housed in the paper housing section 100 is the thermal paper that meets the double-side print mode, which can be printed by the first thermal head 2 and second thermal head 4.

In the thermal printer 90 according to the third embodiment, in the case where a paper other than the obverse-sided thermal paper P2 is loaded in the paper housing section 100 although the single-sided print mode has been set, an error is notified. Therefore, in the case where the single-sided print mode in which only the first thermal head 2 is used to perform print operation, the obverse-sided thermal paper P2 that meets this mode can be loaded without fail.

Further, also in the case where the obverse-sided thermal paper P2 is loaded in the paper housing section 100 although a print mode other than the single-sided print mode has been set, an error is notified. Therefore, an erroneous operation in which a mode other than the single-sided print mode is set although the obverse-sided thermal paper P2 has been loaded can be prevented.

In the third embodiment, the obverse-sided thermal paper P2 is used as a thermal paper used in the single-sided print mode. However, the single-sided thermal paper includes also the reverse-sided thermal printer P3 having the thermosensitive layer 63 formed only on the reverse side 1B. Then, in the thermal printer 90, the first mark sensor 7A is provided at the position opposite to the second mark sensor 7B across the paper. Further, as the single-sided print mode, obverse-sided print mode and reverse-sided print mode are prepared. Thus, in the case where the reverse-sided print mode has been set, the reverse-sided thermal paper P3 can be loaded without fail.

The thermal paper is not limited to one made of a paper material. For example, a medium made of film-shaped synthetic resin may be used as the thermal paper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

a feeding mechanism which feeds one of thermal papers which include a double-sided thermal paper having thermosensitive layers formed on both sides thereof and a single-sided thermal paper having a thermosensitive layer formed on one side thereof;

a first thermal head which is so provided as to be brought into contact with a first side of the thermal paper fed by the feeding mechanism and is configured to print an image on the first side of the paper;

a second thermal head which is so provided as to be brought into contact with a second side of the thermal paper fed by the feeding mechanism and is configured to print an image on the second side of the paper;

a mark determination section which is configured to determine whether a mark has been printed on at least one of the first and second sides of the thermal paper; and a controller which is configured to control print operation based on a determination result from the mark determination section, wherein the controller is configured to control double-sided printing by the first and second thermal heads in the case where the mark determination section has determined that a mark has been printed on both the first and second sides of the thermal paper, the controller is configured to control single-sided printing by the first thermal head in the case where the mark determination section has determined that a mark has been printed on the first side of the thermal paper and control single-sided printing by the second thermal head in the case where the mark determination section has determined that a mark has been printed on one of the second side of the thermal paper.

2. A thermal printer comprising:

a feeding mechanism which feeds one of thermal papers which include a double-sided thermal paper having thermosensitive layers formed on both sides thereof and a single-sided thermal paper having a thermosensitive layer formed on one side thereof;

a first thermal head which is so provided as to be brought into contact with a first side of the thermal paper fed by the feeding mechanism and is configured to print an image on the first side of the paper;

a second thermal head which is so provided as to be brought into contact with a second side of the thermal paper fed by the feeding mechanism and is configured to print an image on the second side of the paper;

a mark determination section which is configured to determine whether a mark has been printed on at least one of the first and second sides of the thermal paper;

a controller which is configured to control print operation based on a determination result from the mark determination section;

a first mark sensor which detects a mark printed on the first side of the thermal paper; and a second mark sensor which detects a mark printed on the second side of the thermal paper, wherein the mark determination section is configured to make determination based on detection signals from the first and second mark sensors.

3. The thermal printer according to claim 2, comprising:

a mark print section which is configured to print the mark on both the first and second sides of the thermal paper using the first and second thermal heads, wherein the first and second mark sensors are disposed on the downstream side in the paper feeding direction relative to the first and second thermal heads.

4. A thermal printer comprising:

a feeding mechanism which feeds one of thermal papers which include a double-sided thermal paper having thermosensitive layers formed on both sides thereof and a single-sided thermal paper having a thermosensitive layer formed on one side thereof;

a first thermal head which is so provided as to be brought into contact with a first side of the thermal paper fed by the feeding mechanism and is configured to print an image on the first side of the paper;

a second thermal head which is so provided as to be brought into contact with a second side of the thermal paper fed by the feeding mechanism and is configured to print an image on the second side of the paper;

a mark determination section which is configured to determine whether a mark has been printed on at least one of the first and second sides of the thermal paper;

a controller which is configured to control print operation based on a determination result from the mark determination section;

a first image buffer in which print data to be printed on the first side of the thermal paper by the first thermal head is rendered as raster image data and stored; and a second image buffer in which print data to be printed on the second side of the thermal paper by the second thermal head is rendered as raster image data and stored wherein the controller is configured to control double-sided print, in the case where the mark determination section has determined that a mark has been printed on both the first and second sides of the thermal paper, by rendering received print data as raster image data so as to store the rendered raster image data respectively in the first and second image buffers and outputting the raster image data stored in the image buffers to the corresponding first and second thermal heads.

5. The thermal printer according to claim 4, wherein the controller is configured to control single-sided print, in the case where the mark determination section has determined that a mark has been printed on one of the first and second sides of the thermal paper, by rendering received print data as raster image data so as to store the rendered raster image data in one of the first and second image buffers corresponding to the thermal head which is so provided as to be brought into contact with a side on which the mark has been determined to be printed and outputting the raster image data stored in one of the image buffers to the corresponding first or second thermal head.

6. A thermal printer comprising:

a feeding mechanism which feeds one of thermal papers which include a double-sided thermal paper having thermosensitive layers formed on both sides thereof and a single-sided thermal paper having a thermosensitive layer formed on one side thereof;

a first thermal head which is so provided as to be brought into contact with a first side of the thermal paper fed by the feeding mechanism and is configured to print an image on the first side of the paper;

a second thermal head which is so provided as to be brought into contact with a second side of the thermal paper fed by the feeding mechanism and is configured to print an image on the second side of the paper;

a mark determination section which is configured to determine whether a mark has been printed on at least one of the first and second sides of the thermal paper;

a controller which is configured to control print operation based on a determination result from the mark determination section; and a mark print section which is configured to print the mark on the thermal paper using one of the first and second thermal heads, wherein the mark determination section is configured to determine whether the mark print section has printed the mark on the thermal printer, and the controller is configured to control double-sided printing by the first and second thermal heads in the case where the mark determination section determines that the mark has been printed the controller is configured to control single-sided printing by one of the first and second printer heads in the case where the mark determination section has determined that the mark has not been printed.

7. A thermal printer comprising:

a feeding mechanism which feeds one of thermal papers which include a double-sided thermal paper having thermosensitive layers formed on both sides thereof and a single-sided thermal paper having a thermosensitive layer formed on one side thereof;

a first thermal head which is so provided as to be brought into contact with a first side of the thermal paper fed by the feeding mechanism and is configured to print an image on the first side of the paper;

a second thermal head which is so provided as to be brought into contact with a second side of the thermal paper fed by the feeding mechanism and is configured to print an image on the second side of the paper;

a mark determination section which is configured to determine whether a mark has been printed on at least one of the first and second sides of the thermal paper;

a controller which is configured to control print operation based on a determination result from the mark determination section;

a paper determination section which is configured to determine, when the first thermal head is used to print an image on the single-sided thermal paper, that the paper has been loaded properly based on the determination by the mark determination section that a mark has been printed on the first side while determine that the paper has not been loaded properly based on the determination by the mark determination section that a mark has not been printed on the first side.

8. A thermal printer comprising:

a feeding mechanism which feeds one of thermal papers which include a double-sided thermal paper having thermosensitive layers formed on both sides thereof and a single-sided thermal paper having a thermosensitive layer formed on one side thereof;

a first thermal head which is so provided as to be brought into contact with a first side of the thermal paper fed by the feeding mechanism and is configured to print an image on the first side of the paper;

a second thermal head which is so provided as to be brought into contact with a second side of the thermal paper fed by the feeding mechanism and is configured to print an image on the second side of the paper;

a mark determination section which is configured to determine whether a mark has been printed on at least one of the first and second sides of the thermal paper;

a controller which is configured to control print operation based on a determination result from the mark determination section; and a paper determination section which is configured to determine, when the first and second thermal heads are used to print an image on the double-sided thermal paper, that the paper has been loaded properly based on the determination by the mark determination section that a mark has not been printed on the paper while determine that the paper has not been loaded properly based on the determination by the mark determination section that any mark has been printed on the paper.

9. A paper recognition method of a printer which includes: a feeding mechanism which feeds one of thermal papers which include a double-sided thermal paper having thermosensitive layers formed on both sides thereof and a single-sided thermal paper having a thermosensitive layer formed on one side thereof; a first thermal head which is so provided as to be brought into contact with a first side of the thermal paper fed by the feeding mechanism and is configured to print an image on the first side of the paper; and a second thermal head which is so provided as to be brought into contact with a second side of the thermal paper fed by the feeding mechanism and is configured to print an image on the second side of the paper, the method comprising:

determining whether a mark has been printed at least one of the first and second sides of the thermal paper;

recognizing a paper type based on a result of the determination; and driving the first and second thermal heads to print the mark on both the first and second sides of the thermal paper.

10. A paper recognition method of a printer which includes: a feeding mechanism which feeds one of thermal papers which include a double-sided thermal paper having thermosensitive layers formed on both sides thereof and a single-sided thermal paper having a thermosensitive layer formed on one side thereof; a first thermal head which is so provided as to be brought into contact with a first side of the thermal paper fed by the feeding mechanism and is configured to print an image on the first side of the paper; and a second thermal head which is so provided as to be brought into contact with a second side of the thermal paper fed by the feeding mechanism and is configured to print an image on the second side of the paper, the method comprising:

determining whether a mark has been printed at least one of the first and second sides of the thermal paper; and recognizing a paper type based on a result of the determination, wherein in the case where the mark is determined to have been printed on both the first and second sides of the thermal paper, it is recognized that the double-sided thermal paper has been loaded, while in the case where the mark is determined to have been printed only on one of the first and second sides of the thermal paper, it is recognized that the single-sided thermal paper has been loaded.

11. A paper recognition method of a printer which includes: a feeding mechanism which feeds one of thermal papers which include a double-sided thermal paper having thermosensitive layers formed on both sides thereof and a single-sided thermal paper having a thermosensitive layer formed on one side thereof; a first thermal head which is so provided as to be brought into contact with a first side of the thermal paper fed by the feeding mechanism and is configured to print an image on the first side of the paper; and a second thermal head which is so provided as to be brought into contact with a second side of the thermal paper fed by the feeding mechanism and is configured to print an image on the second side of the paper, the method comprising:

determining whether a mark has been printed at least one of the first and second sides of the thermal paper; and recognizing a paper type based on a result of the determination, wherein when the first thermal head is used to print an image on the single-sided thermal paper, it is recognized that the paper has been loaded properly if a mark has been printed on the first side, while it is recognized that the paper has not been loaded properly if a mark has not been printed on the first side.

12. A paper recognition method of a printer which includes: a feeding mechanism which feeds one of thermal papers which include a double-sided thermal paper having thermosensitive layers formed on both sides thereof and a single-sided thermal paper having a thermosensitive layer formed on one side thereof; a first thermal head which is so provided as to be brought into contact with a first side of the thermal paper fed by the feeding mechanism and is configured to print an image on the first side of the paper; and a second thermal head which is so provided as to be brought into contact with a second side of the thermal paper fed by the feeding mechanism and is configured to print an image on the second side of the paper, the method comprising:

determining whether a mark has been printed at least one of the first and second sides of the thermal paper; and recognizing a paper type based on a result of the determination, wherein when the first and second thermal heads are used to print an image on the double-sided thermal paper, it is recognized that the paper has been loaded properly if a mark has not been printed on the paper, while it is recognized that the paper has not been loaded properly if any mark has been printed on the paper.

* * * * *

UNITED STATES PATENT AND TRADEMARK OFFICE

CERTIFICATE OF CORRECTION

PATENT NO. : 7,671,878 B2
APPLICATION NO. : 11/681930
DATED : March 2, 2010
INVENTOR(S) : Satoshi Yamada and Sumio Baba It is certified that error appears in the above-identified patent and that said Letters Patent is hereby corrected as shown below:

On the title page item (73) Assignee: Toshiba Tec Kabushiki Kaisha, Tokyo (JP)

It should read:

(73) Assignee: Toshiba Tec Kabushiki Kaisha, Tokyo (JP);
NCR Corporation, Dayton, OH (US)

Signed and Sealed this

Twenty-eighth Day of September, 2010

David J. Kappos

David J. Kappos
*Director of the United States Patent and Trademark Office*